US011352993B2

(12) United States Patent
Mehring

(10) Patent No.: US 11,352,993 B2
(45) Date of Patent: Jun. 7, 2022

(54) FUEL DISTRIBUTOR

(71) Applicant: BENTELER AUTOMOBILTECHNIK GMBH, Paderborn (DE)

(72) Inventor: Markus Mehring, Lichtenau (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 17/111,653

(22) Filed: Dec. 4, 2020

(65) Prior Publication Data

US 2021/0172414 A1 Jun. 10, 2021

(30) Foreign Application Priority Data

Dec. 4, 2019 (DE) ..... 10 2019 133 050.5

(51) Int. Cl.
*F02M 55/02* (2006.01)
*F02M 55/00* (2006.01)

(52) U.S. Cl.
CPC ..... *F02M 55/025* (2013.01); *F02M 55/005* (2013.01); *F02M 2200/856* (2013.01); *F02M 2200/857* (2013.01)

(58) Field of Classification Search
CPC .... F02M 55/02; F02M 55/025; F02M 55/004; F02M 55/005; F02M 59/48; F02M 2200/856
See application file for complete search history.

(56) References Cited

U.S. PATENT DOCUMENTS

| | | | | |
|---|---|---|---|---|
| 6,148,797 | A | 11/2000 | Gmelin | |
| 6,488,011 | B1 | 12/2002 | Frank et al. | |
| 2011/0094477 | A1 | 4/2011 | Mehring et al. | |
| 2013/0047961 | A1* | 2/2013 | Stichlmeir | F02M 55/004 123/446 |
| 2014/0041636 | A1* | 2/2014 | Di Domizio | F02M 61/14 123/470 |

(Continued)

FOREIGN PATENT DOCUMENTS

| | | | |
|---|---|---|---|
| CN | 109139318 | A | 1/2019 |
| DE | 69410480 | T2 | 11/1998 |

(Continued)

OTHER PUBLICATIONS

DE 202014104466 U1 English machine translation of description provided by ESPACENET (Year: 2021).*

(Continued)

*Primary Examiner* — Michael A Kessler
(74) *Attorney, Agent, or Firm* — Hauptman Ham, LLP

(57) ABSTRACT

A fuel distributor which has a pressure accumulator pipe for receiving pressurized fuel where the pressure accumulator pipe has a forged main body with a longitudinal cavity. At least one connector flange is configured in one piece from the same material on the main body. The connector flange has an injector connector with a connecting duct to the longitudinal cavity. A cup-shaped injector receptacle is joined to the injector connector. The injector receptacle is a single-piece deep-drawn part or a single-piece extruded part or a single-piece turn-milled part, and is connected to the injector connector by way of a fuel-tight join, or by way of brazing technology.

8 Claims, 5 Drawing Sheets

(56) References Cited

U.S. PATENT DOCUMENTS

| | | | | |
|---|---|---|---|---|
| 2014/0123945 | A1* | 5/2014 | Maier | F02M 55/025 123/445 |
| 2019/0093614 | A1* | 3/2019 | Renner | F02M 55/025 |

FOREIGN PATENT DOCUMENTS

| | | | | |
|---|---|---|---|---|
| DE | 19756102 | A1 | 6/1999 | |
| DE | 102008044923 | A1 | 3/2010 | |
| DE | 202014104466 | U1 * | 9/2014 | F02M 61/168 |
| DE | 202014104466 | U1 | 9/2014 | |
| DE | 102016124494 | A1 * | 6/2018 | F02M 61/168 |
| DE | 202017101954 | U1 | 7/2018 | |
| DE | 102018110342 | A1 | 10/2019 | |
| EP | 1524428 | A2 * | 4/2005 | B23K 11/26 |
| EP | 2006530 | A1 * | 12/2008 | F02M 55/025 |
| EP | 2317118 | A2 | 5/2011 | |
| JP | 2013072416 | A | 4/2013 | |
| JP | 102018110342 | A1 | 10/2019 | |
| WO | 0109507 | A1 | 2/2001 | |
| WO | 2018069382 | A1 | 4/2018 | |

OTHER PUBLICATIONS

EP 2006530 A1 English machine translation of description provided by ESPACENET (Year: 2021).*

DE 102008044923 A1 English machine translation of description provided by ESPACENET (Year: 2021).*

Extended European Search Report for European Application No. 20206861.5 dated Apr. 14, 2021; 12pp.

Office Action for German Application No. 10 2019 133 050.5 dated Aug. 21, 2020; 16pp.

Office Action for Chinese Application No. 20201 1409334.6 dated Feb. 15, 2022; 70pp.

* cited by examiner

FUEL DISTRIBUTOR

RELATED APPLICATIONS

The present application claims priority of German Application Number 10 2019 133 050.5 filed Dec. 4, 2019, the disclosure of which is hereby incorporated by reference herein in its entirety.

FIELD

The present disclosure relates to a fuel distributor.

BACKGROUND

What is known as common rail injection which is also called accumulator fuel injection is an injection system for internal combustion engines, in the case of which a high pressure pump charges fuel to a high pressure level. Said highly pressurized fuel fills a pipeline system which is constantly under pressure during engine operation. Here, the term "common rail" means a common distributor pipe. The distributor pipe forms a high pressure fuel accumulator, to which the injection nozzles or injectors for the supply of the cylinders with fuel are connected. The distributor pipe is therefore also called a pressure accumulator pipe.

At least two designs of high pressure fuel distributors are fundamentally known. They are configured either as brazed assemblies or as fuel distributors which are forged from a solid block.

Brazed assemblies usually have a pressure accumulator pipe, to which functional elements, such as holders and injector receptacles, are brazed. The same applies to the line connector and a sensor adapter. The pipe ends are provided with end covers or else connector stubs which close the pressure accumulator pipe. The brazed assembly is predominantly configured in stainless steel, and is brazed with copper solder in a continuous furnace, as a result of which the assembly gaps are closed. In relation to the increasing pressures in the accumulator injection systems, it is becoming increasingly more difficult in the case of brazed assemblies for the requirements with regard to the durability to be realized. Many components are to be positioned in terms of shape and position on the pressure accumulator, with the result that the required tolerances can be maintained in part only with difficulty. The individual components are also relatively expensive, with the result that it is becoming more and more difficult for brazed fuel distributors to be produced economically.

In the case of forged fuel distributors, the pressure accumulator pipe has a forged main body. This is machined and is provided with a longitudinal bore. Functional regions which are forged on in one piece are subsequently machined, with the result that mounting on the engine can take place, and injectors, lines and sensors can be adapted. Forged fuel distributors are limited by the forging process with regard to their design. Complex machining of the forging blank and the production of burrs during machining lead to great subsequent processes which do not add value.

DE 295 21 402 U1 describes a fuel distributor, in the case of which the pressure accumulator pipe is formed by way of forging with connector stubs and fastening elements which are integrally formed using forging technology. The fastening elements form connecting pieces in the form of fastening eyelets with through holes which are produced by way of drilling operations.

WO 2017/153460 A1 has disclosed a component which is pressure-loaded internally in the form of a pressure accumulator pipe, and a method for producing it. The pressure accumulator pipe has a main body with a longitudinal cavity and a connector flange for the connection of a fluid element, for example a fuel line.

A fuel distributor with a forged pressure accumulator pipe is also apparent from DE 10 2015 212 868 A1. The main body in said document has a cavity and at least one branch with a bore which runs through the branch into the cavity of the main body. Corresponding injection systems of the common rail injection system can be provided on the branch or branches. A separate insert element which has a throttle bore is inserted into the bore of the branch.

Furthermore, a fuel distributor with a forged pressure accumulator pipe from DE 20 2017 101 954 U1 belongs to the prior art. The pressure accumulator pipe has a shaped-out region which is provided for connection to a screw-on element. The screw-on element is a screw-on sleeve, via which fuel is conducted from the central duct of the pressure accumulator pipe to the individual combustion chambers.

SUMMARY

Proceeding from the prior art, the disclosure is based on the object of providing a fuel distributor in terms of manufacturing technology and is improved in terms of components.

The fuel distributor according to the disclosure has a pressure accumulator pipe for receiving pressurized fuel. The pressure accumulator pipe has a forged main body with a longitudinal cavity. At least one connector flange is configured in one piece from the same material on the main body using forging technology. The connector flange has an injector connector with a connecting duct to the longitudinal cavity. An injector receptacle is joined to the injector connector. The injector receptacle serves to receive a connecting section of an injector which is mounted in a cylinder bank. Here, the injector receptacle engages over the connecting section of the injector.

According to the disclosure, the injector receptacle is a single-piece deep-drawn part or a single-piece extruded part or a single-piece turn-milled part. The injector receptacle is connected to the injector connector by way of a fuel-tight join. The injector receptacle can be realized as a deep-drawn part or an extruded part, e.g., a cold extruded part, in an inexpensive manner with a low use of material and with only a small amount of or even no machining. A fuel distributor is produced in terms of manufacturing technology and is improved in terms of components. The disclosure combines a constructed fuel distributor and a forged fuel distributor.

The injector receptacle is rotationally symmetrical. An injector receptacle is a single-piece deep-drawn part. It is produced by way of tension-pressure forming of a sheet metal blank. In this way, the injector receptacle is manufactured as a hollow body which is open on one side or on both sides. If the injector receptacle is manufactured as a hollow body which is open on one side with a closed bottom, openings on the bottom for the passage of fuel are produced by machining or using punching technology. Injector receptacles which are produced using deep-drawing technology with a hollow body which is open on both sides seat a peripheral collar at the engine-side end, that is to say the end which faces away from the injector connector. That end of the hollow body which faces the injector connector is configured as a plug-in or plug-on section. A plug-in section can be plugged into a round receiving opening of the injector connector. A plug-on section can be plugged onto a connector pin of an injector connector.

An injector receptacle which is produced using extruding technology is produced by way of pressure forming of a blank or semifinished product. The injector receptacle is produced as an extruded part by way of cold working.

The injector receptacle can also be a turn-milled part. Turn-milling is a machining method, in the case of which the methods of operation of turning and milling are combined.

The pressure accumulator pipe of the fuel distributor has a forged tubular main body. Within the context of the disclosure, a tubular main body is to be understood to mean an elongate hollow body which, however, is not fixed to a round or circular cross section either with regard to the interior space or with regard to the outer periphery. A round internal cross section in the longitudinal cavity is provided in one or more embodiments. In some embodiments, the longitudinal cavity is usually produced by way of a deep hole drilling operation or blind hole drilling operation.

The fuel-conducting connection between the injector connector and the longitudinal cavity is established by way of a connecting duct. The connecting duct can extend in the longitudinal axis of the injector receptacle. It is also possible that the connecting duct runs transversely with respect to the longitudinal axis of the injector receptacle.

Prefixing of the injector receptacle takes place in order to mount or join the injector receptacle on or in the injector connector. This can take place by way of tack welding, pressing or by way of clinching and other integrally joined and/or positively locking prefixing means. The prefixed injector receptacle is then joined in the injector connector in a fuel-tight manner. This takes place using brazing technology, e.g., in a furnace brazing process. As a result of the thermal treatment in the brazing process, the component is normalized, as a result of which the warping of the overall fuel distributor is reduced.

The main body of the pressure accumulator pipe which is produced using forging technology is made of a chromium-nickel steel alloy. The pressure accumulator pipe is forged from a blank. A corrosion-resistant stainless steel alloy is used as material. The use of stainless steel alloys of the type of material 1.4307 or 1.4301 can be suitable.

Another exemplary embodiment provides that the injector connector has a receiving bore in the connector flange. The injector receptacle is received in a non-positive and positively locking manner and is joined in a fuel-tight manner by way of its upper end which faces toward the injector connector in the receiving bore. This takes place using brazing technology. Even if a join using brazing technology is considered to be within the context of the disclosure, a fuel-tight join using welding technology is fundamentally also possible.

Another exemplary embodiment provides that the connector flange has a connection piece body. The receiving bore for the injector receptacle can be provided in the connection piece body. The connection piece body can also be configured for receiving the injector receptacle, in such a way that the injector receptacle engages around the connection piece body with its end which faces the injector connector, that is to say on the injector connector side, or a joining section of the injector receptacle engages into the connection piece body.

The connection piece body can be stepped and can have a joining section or pin which is engaged around on the outside by an injector receptacle. The injector receptacle is placed onto the joining section or pin of the connection piece body, with the result that it engages around the latter in a radially peripheral manner. A secure pressure-tight connector is ensured by way of the fuel-tight join.

One aspect of the disclosure provides that the longitudinal axis which extends through the injector receptacle and the longitudinal axis which runs through the longitudinal cavity are arranged offset with respect to one another. The flange section is then arranged offset laterally on a longitudinal side of the main body, in relation to the vertical center longitudinal plane of the longitudinal cavity.

An alternative aspect of the disclosure provides that the longitudinal axis which runs through the injector receptacle and the longitudinal axis of the cavity intersect. The flange section is then arranged in the vertical center longitudinal plane of the longitudinal cavity in the installed position of the fuel distributor on the underside of the main body.

Single-piece regions are configured using forging technology as connector flanges along the longitudinal axis. The same can also take place for sensor receptacles or line connectors. Said regions are machined by way of milling and drilling. The connector flanges are provided with the injector connectors. The machined forging blank then forms the main body. There, the injector receptacles are fixed and joined in a fuel-tight manner, e.g., brazed, on or in the injector connectors. Further machining of the pressure accumulator pipe does not need to take place.

In another exemplary embodiment, the injector receptacle has a hollow-cylindrical length portion, a collar which is turned over toward the outside being configured at that end of the length portion which faces away from the injector connector. The collar is of peripheral configuration.

The injector receptacle can be open at its end which faces the injector connector.

A further refinement of the disclosure provides that the injector receptacle or the hollow-cylindrical length portion has a bottom with a through opening at the injector connector-side end, that is to say at the end which faces the injector connector.

A further refinement provides that the injector receptacle has a bottom with a passage at the injector connector-side end. The passage realizes a through opening in the bottom of the injector receptacle with a peripheral collar which projects to the outside, that is to say in the direction of the injector connector. The collar engages into the injector receptacle-side end of the connecting duct in the injector connector.

Another exemplary embodiment provides that a mounting base is configured in one piece from the same material on the flange section. The mounting base can overall form a support for fixing the fuel distributor in the engine compartment of a motor vehicle. It is also possible that the mounting base serves to fix a spacer element, for example a supporting sleeve or a stand. The fuel distributor is fixed via the mounting base and/or the spacer element, for example via fastening screws. The spacer elements are joined using brazing technology, to the mounting base in an integrally joined manner.

A further alternative refinement of the fuel distributor provides that the longitudinal cavity is closed by way of a deep-drawn or extruded end piece at least at one end.

Furthermore, in the case of the fuel distributor according to the disclosure, a sensor receptacle can be configured in one piece from the same material on the main body by way of forging.

The disclosure proceeds from a relatively compact forged main body of the pressure accumulator pipe as basis. Single-piece regions for mounting in the engine compartment, e.g., on the cylinder head, and for receiving the injectors are provided along the longitudinal axis. The same applies to sensor receptacles and/or other line connectors. The main body is machined by way of milling and drilling to have the longitudinal cavity. The connector flange or flanges is/are also machined and configured for fixing the injector receptacles. The injector receptacles are prefixed in the injector connectors. Ensuring of the tightness takes place subsequently in a brazing process, in the case of which the main body is brazed with sealed gaps to the preassembled injector receptacles and possibly further attachment parts, such as end pieces or sensor receptacles. Very high positional tolerances of the assembly can be ensured in this way. Nevertheless, the number of brazed points is manageable, as a result of which a high degree of safety is ensured.

The injector receptacles can be produced inexpensively as deep-drawn parts or extruded parts. As a result, the expensive machining of the forging blank can be reduced with regard to the operating time. Deburring of the functional regions of the injector connector, is not required or is required merely to a small extent.

The overall weight of a fuel distributor can be reduced by way of configuration according to the disclosure.

A method according to the disclosure for producing a fuel distributor provides the following steps:

- providing of an elongate forging blank, on which a connector flange is configured in one piece from the same material using forging technology;
- machining of the forging blank, in the case of which the longitudinal cavity is produced in the forging blank by means of deep hole drilling, and an injector connector is produced on the connector flange;
- providing of an injector receptacle in the form of a single-piece deep-drawn part or a single-piece extruded part or a single-piece turn-milled part;
- non-positive and/or positively locking prefixing of the injector receptacle on or in the injector connector;
- fuel-tight joining of the injector receptacle to the injector connector by way of a furnace brazing process.

The production of the longitudinal cavity, and also that of receiving bores for the injector receptacles or the connecting ducts between the longitudinal cavity and the injector connector, takes place by way of drilling. The machining of connector sections, for example on the connection piece body of the injector connector or the connector flange, takes place with the removal of material by way of turning or milling operations. Subsequently, the deep-drawn or extruded attachment parts, e.g., the injector receptacles, are fixed and joined in an integrally joined manner on the machined forging blank. The injector receptacles are connected in a fuel-tight manner to the injector connectors.

Machining after the joining process, which is, a furnace brazing process, is not required.

BRIEF DESCRIPTION OF THE DRAWINGS

The disclosure is described in further detail in the following text on the basis of exemplary embodiments which are shown in the drawings, in which.

Figure 1:
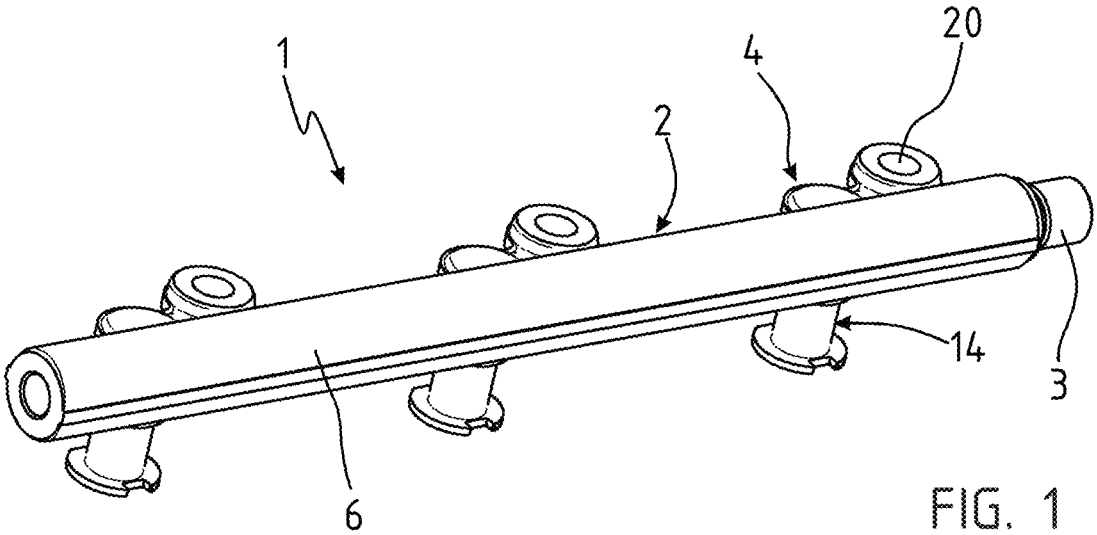
FIG. 1 shows a fuel distributor according to the disclosure in a perspective view.
Figure 2:
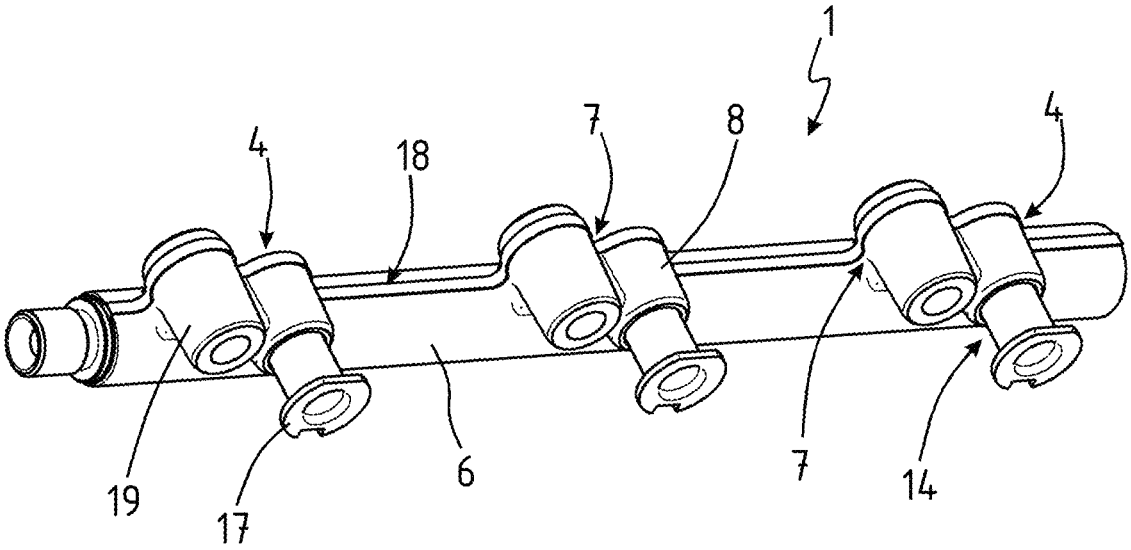
FIG. 2 shows the fuel distributor according to FIG. 1 in another perspective.
Figure 3:
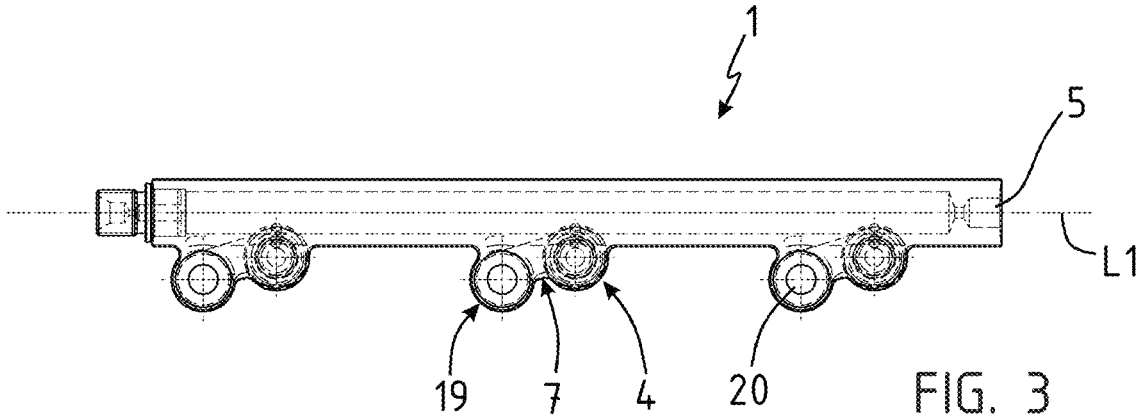
FIG. 3 shows the fuel distributor in a plan view.
Figure 4:
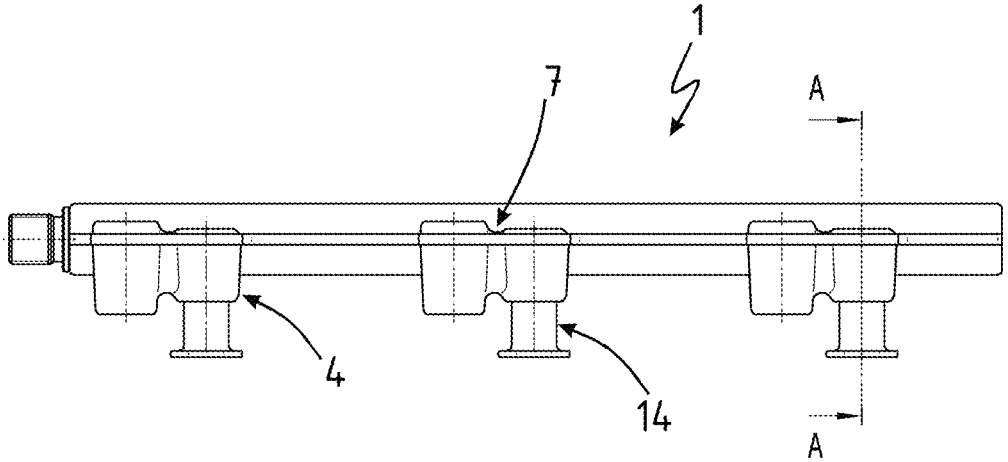
FIG. 4 shows the fuel distributor in a side view.
Figure 5:
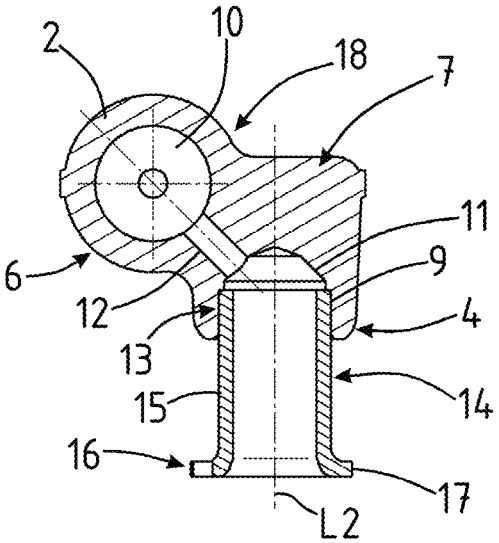
FIG. 5 shows a section through the illustration of FIG. 4 along the line A-A.

Elements and element components which correspond to one another are provided with the same reference signs in FIGS. 1 to 14.

DETAILED DESCRIPTION

FIGS. 1 to 5 show a first embodiment of a fuel distributor 1 according to the disclosure.

The fuel distributor 1 belongs to the accumulator system of an internal combustion engine. The pressure generation and the fuel injection are decoupled from one another in the case of accumulator injection systems of this type. A separate high pressure pump generates pressure continuously. Said pressure which is built up independently of the injection sequence is permanently available in the fuel distributor 1.

The fuel distributor 1 comprises a pressure accumulator pipe 2 with a pump-side high pressure fuel connector 3 and a plurality of injector connectors 4. The statically compressed fuel is stored in the pressure accumulator pipe 2 and is provided in a manner which is distributed via the injector connectors 4 to the injectors (not shown here) of a cylinder bank. A pressure sensor connector 5 is provided for the connection of a pressure sensor.

The pressure accumulator pipe 2 has a forged main body 6. Connector flanges 7 are configured in one piece from the same material on the main body 6 using forging technology. After the forging, the main body 6 is machined. The injector connectors 4 are configured on the connector flanges 7. Each connector flange 7 has a connection piece body 8. The connection piece body 8 projects downward in the installed position with respect to the main body 6 of the pressure accumulator pipe 2. An injector connector 4 has a receiving bore 9 in the connector flange 7, which receiving bore 9 is made in the connection piece body 8.

A longitudinal cavity 10 is made in the main body 6 by means of deep hole drilling. The longitudinal cavity 10 has a longitudinal axis L1.

The longitudinal cavity 10 and the injector connector 4 are connected in a fuel-conducting manner by way of a connecting duct 12 which runs from the bottom 11 of the receiving bore 9 transversely in the direction of the longitudinal cavity 10.

The injector connector 4 receives the injector connector-side end 13 of an injector receptacle 14. The injector receptacle 14 is a single-piece deep-drawn part or a single-piece extruded part, for example made from a stainless steel alloy. An injector receptacle 14 can also be configured as a single-piece turn-milled part.

The injector receptacle 14 is of cup-like configuration and is inserted into the cylindrical receiving bore 9. The injector receptacle 14 has a hollow-cylindrical length portion 15. The latter serves to receive the upper part of an injector. A peripheral collar 17 which is turned over toward the outside is configured at that end 16 of the length portion 15 which faces away from the injector connector 4. The collar 17 forms a lower contact face or supporting face on the injector receptacle 14.

That end 13 of the injector receptacle 14 which faces the injector connector 4 is open. The injector receptacle 14 is inserted into the receiving bore 9 and is prefixed there. This can take place using pressing technology of by means of tack welding or other prefixing means. After the prefixing, solder is applied, and the injector receptacle 14 is joined in an integrally joined and fuel-tight manner in the injector connector 4. The brazing process takes place in a furnace brazing system, in the case of which all brazing operations on the fuel distributor 1 are carried out in one furnace pass.

The longitudinal axis L2 which extends through the injector receptacle 14 is offset laterally with respect to the longitudinal axis L1 which extends through the longitudinal cavity 10. The connector flange 7 and the injector connector 4 are thus arranged laterally on a longitudinal side 18 of the pressure accumulator pipe 2, in relation to the installed position of the fuel distributor 1.

It can be seen, furthermore, that in each case one mounting base 19 is configured on the connector flange 7. This has taken place in the course of the production of the main body 6 using forging technology. The mounting base 19 or the mounting bases 19 has/have a through bore 20. The latter serves to guide through mounting elements, e.g., fastening screws, by means of which the fuel distributor 1 can be fixed in an engine compartment. In that exemplary embodiment of the fuel distributor 1 which is shown here, the mounting bases 19 configure pedestals which extend between the pressure accumulator pipe 2 and the mounting point. One alternative (not shown here) provides that additional spacer elements, for example sleeves, are mounted on the mounting base 19. The spacer elements are joined in an integrally joined manner to the mounting base 19. It can be seen that the injector connectors 4 and the mounting bases 19 are configured on the connector flange 7. The connector flange 7 comprises in each case one mounting base 19 and one injector connector 4 formed from the same material.

Figure 6:
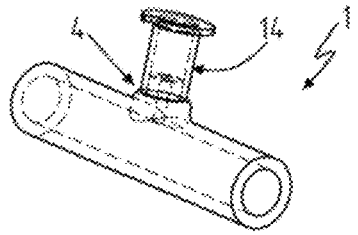
FIG. 6 shows a detail from a further embodiment of a fuel distributor in a perspective illustration.
Figure 7:
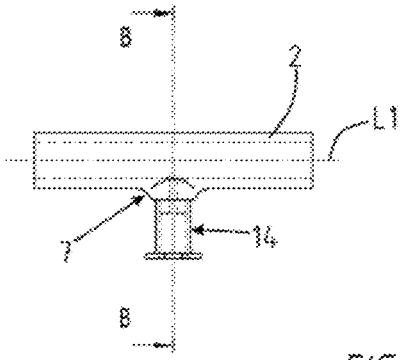
FIG. 7 shows the detail of the fuel distributor in accordance with FIG. 6 in a side view.
Figure 8:
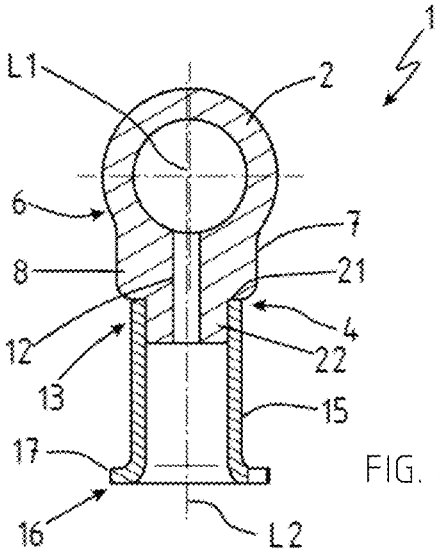
FIG. 8 shows a section through the illustration of FIG. 7 along the line B-B.

In the case of the fuel distributor 1 which is shown in FIGS. 6 to 8, the longitudinal axis L2 which runs through the injector receptacle 14 and the longitudinal axis L1 of the cavity 10 intersect. The connector flange 7 has a connection piece body 8. A pin 22 is configured on the connection piece body 8 via a step 21. The injector receptacle 14 is placed with its injector receptacle-side end 13 onto the pin 22. The end 13 engages around the pin 22 peripherally. The injector receptacle 14 is joined to the connector flange 7. The connecting duct 12 extends in the direction of the longitudinal axis L1 of the injector receptacle 14 through the injector connector 4 as far as into the longitudinal cavity 10. In relation to the mounted position of the fuel distributor 1, the connecting duct 12 runs in a vertically directed manner through the pin 22 and the connection piece body 8 of the connector flange 7.

The injector receptacle 14 is a deep-drawn part or an extruded part, and is configured as a cup which is open toward the top. The injector receptacle 14 is pressed onto the cylindrical pin 22 of the connection piece body 8. The prefixing of the injector receptacle 14 thus takes place by way of a press fit. Prefixing by way of tack welding is also conceivable here. The final fuel-tight join takes place by way of a brazing process in a continuous furnace.

Figure 9:
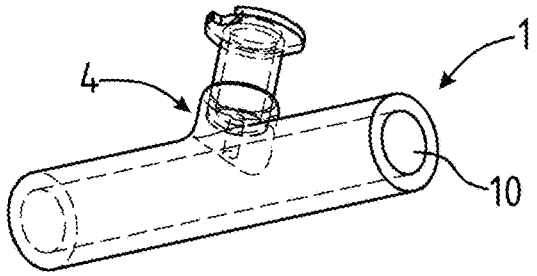
FIG. 9 shows a detail from a further embodiment of a fuel distributor in a perspective illustration.
Figure 10:
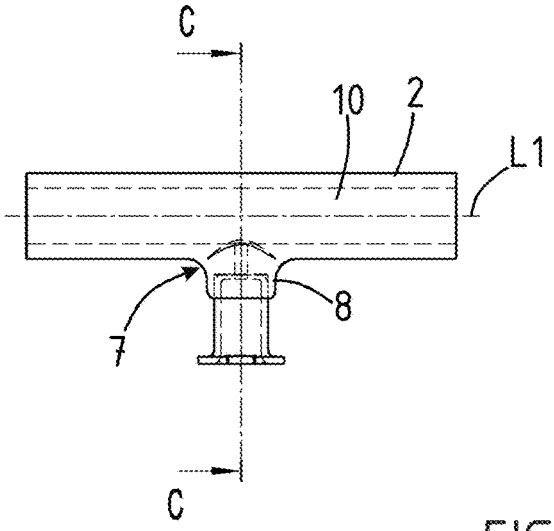
FIG. 10 shows the detail of the fuel distributor in accordance with FIG. 9 in a side view.
Figure 11:
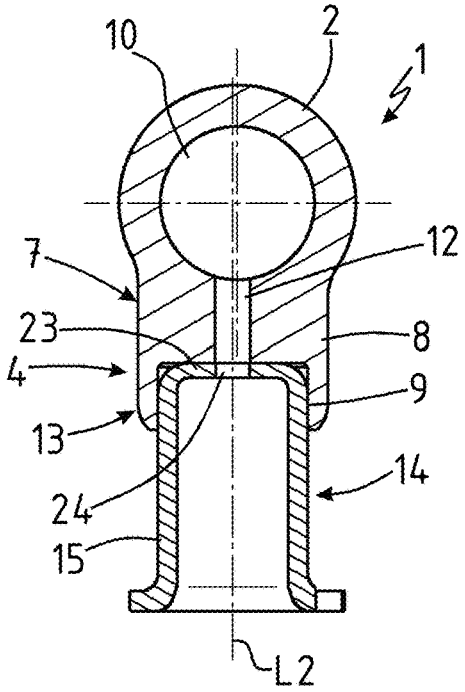
FIG. 11 shows a section through the illustration of FIG. 10 along the line C-C.

In the case of the fuel distributor 1 which is shown in FIGS. 9 to 11, the injector connector 4 is configured in the connector flange 7. The connector flange 7 has a connection piece body 8 with a cylindrical receiving bore 9. The injector receptacle 14 is inserted and joined with its injector connector-side end 13 into/in said receiving bore 9. At the end 13, the injector receptacle 14 has a bottom 23 with a through opening 24. The injector receptacle 14 is also a deep-drawn part or an extruded part in this exemplary embodiment.

Figure 12:
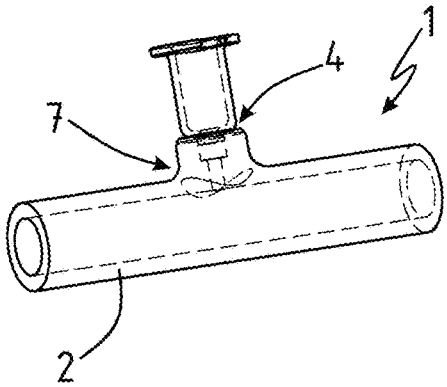
FIG. 12 shows a detail from a further embodiment of a fuel distributor in a perspective illustration.
Figure 13:
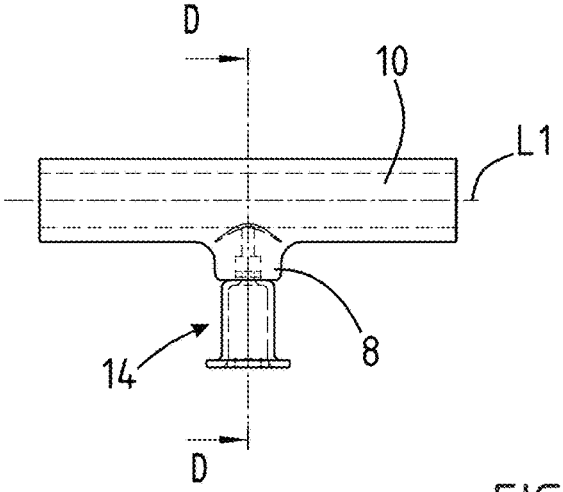
FIG. 13 shows the detail of the fuel distributor in accordance with FIG. 12 in a side view.
Figure 14:
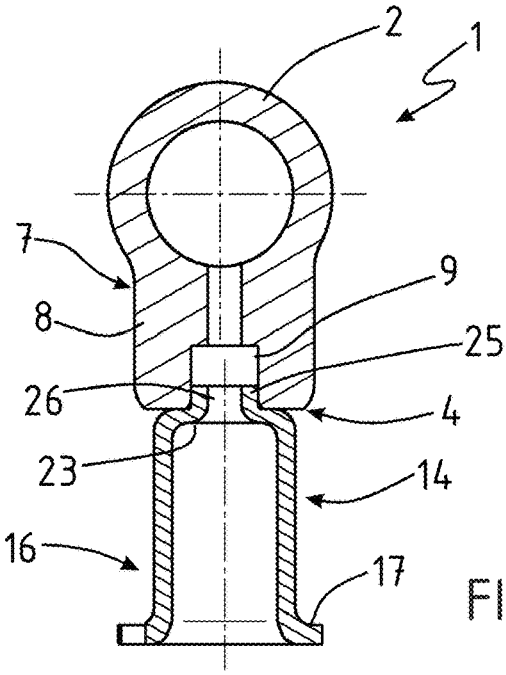
FIG. 14 shows a section through the illustration of FIG. 13 along the line D-D.

The fuel distributor 1 in accordance with the illustration of FIGS. 12 to 14 has a connector flange 7 with an injector connector 4. The injector connector 4 is configured in a connection piece body 8 of the connector flange 7. A receiving bore 9 is made in the free end of the connection piece body 8. Said receiving bore 9 continues in a stepped manner into the connecting duct 12. The injector receptacle 14 is a deep-drawn part or an extruded part. The injector receptacle 14 has a central length portion 15 with a peripheral collar 17 at the end 16. At the injector-side end 13, the injector receptacle 14 has a bottom 23 with a passage 25. The passage 25 delimits the through opening 26 peripherally. The injector receptacle 14 is pressed by way of the passage 25 into the receiving bore 9, and is joined there in an integrally joined manner. This takes place by way of brazing, but can also be configured by way of welding.

The foregoing description of some embodiments of the disclosure has been presented for purposes of illustration and description. It is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A fuel distributor, comprising:

a pressure accumulator pipe for receiving pressurized fuel, the pressure accumulator pipe comprising:

a forged main body having a longitudinal cavity, and at least one connector flange being configured in one piece from a same material on the forged main body, wherein the at least one connector flange has an injector connector and a mounting base; and an injector receptacle joined to the injector connector, wherein the injector receptacle is a single-piece deep-drawn part, the injector connector comprises a connection piece body and a pin, the pin is configured on the connection piece body via a step, and the injector receptacle has an end which receives and engages around the pin peripherally, and the injector receptacle is connected to the injector connector by way of a fuel-tight join.

2. The fuel distributor according to claim 1, wherein the injector receptacle is joined to the injector connector by way of brazing technology.

3. The fuel distributor according to claim 1, wherein the injector receptacle has a first longitudinal axis, the longitudinal cavity has a second longitudinal axis, and the first longitudinal axis is offset laterally with respect to the second longitudinal axis.

4. The fuel distributor according to claim 1, wherein
the injector receptacle has a first longitudinal axis,
the longitudinal cavity has a second longitudinal axis, and
the first longitudinal axis of the injector receptacle and the second longitudinal axis of the longitudinal cavity intersect.

5. The fuel distributor according to claim 1, wherein
the injector receptacle has
a hollow-cylindrical length portion having the end which receives and engages around the pin peripherally, and
a collar turned over toward an outside and being configured at another end of the hollow-cylindrical length portion which faces away from the injector connector.

6. The fuel distributor according to claim 5, wherein the mounting base has a through bore for fixing the fuel distributor in an engine compartment.

7. The fuel distributor according to claim 1, further comprising a deep-drawn or extruded end piece that closes one end of the longitudinal cavity.

8. The fuel distributor according to claim 1, further comprising at least one sensor receptacle configured in one piece from the same material on the forged main body.

* * * * *